United States Patent [19]

Burg et al.

[11] Patent Number: 4,865,562

[45] Date of Patent: Sep. 12, 1989

[54] OVERMOLDED ELECTRICAL CONTACT FOR THE MANUFACTURE OF CONNECTORS

[75] Inventors: John S. Burg, Cedar Park, Tex.; Hirochika Enn, Sagamihara, Japan; Lane A. Freshwater, Chico, Calif.

[73] Assignee: Minnesota Mining and Manufacturing Company, St. Paul, Minn.

[21] Appl. No.: 261,983

[22] Filed: Oct. 24, 1988

Related U.S. Application Data

[62] Division of Ser. No. 151,316, Feb. 1, 1988, abandoned.

[51] Int. Cl.[4] ..... H01R 4/24

[52] U.S. Cl. ..... 439/395; 439/736; 439/885

[58] Field of Search ..... 439/736, 885, 389–426

[56] References Cited

U.S. PATENT DOCUMENTS 4,054,354 10/1977 Unger ..... 439/885

*Primary Examiner*—Joseph H. McGlynn

*Attorney, Agent, or Firm*—Donald M. Sell; Walter N. Kirn; John C. Barnes

[57] ABSTRACT

Closely spaced electrical contacts are increasingly difficult to place in the manufacture of connectors and a strip molded onto stamped contact elements provide locating and alignment of the contact elements to make the same easily located in molded housing or tooling for molding. Wire support surfaces molded as part of the strip insure placement of conductors for connection with the contact elements.

10 Claims, 4 Drawing Sheets

OVERMOLDED ELECTRICAL CONTACT FOR THE MANUFACTURE OF CONNECTORS

CROSS REFERENCE TO RELATED APPLICATION

This application is a division of application Ser. No. 151,316 filed Feb. 1, 1988, now abandoned.

BACKGROUND OF THE INVENTION

1. Field of the Invention

This invention relates to a connector formed with individual contact elements and in one aspect to a connector for use with electronic cable components with closely spaced conductors, where the conductors are positioned on 0.025 inch (0.63 mm) centers, to form a cable termination socket or header.

2. Description of the Prior Art

Cable terminations for flat cable are well known and it is typical to connect the individual wires of such a cable to individual contact elements in an insulative housing. The contacts typically have an end portion formed to make electrical contact with the individual wires in the cable. A cap is then placed onto the housing to maintain the wires in contact with the contact elements. This construction is illustrated in U.S. Pat. Nos. 3,434,093 and 3,444,506 illustrating solderless flat cable wire connectors. Alternatively, the junction between the wire of the flat cable and the contact element can be encapsulated by molding directly over the junctions as illustrated in U.S. Pat. Nos. 4,030,799 and 4,094,564.

As the spacing for the wires in the flat cable become increasingly smaller, i.e. from 0.05 inch centers for 22 to 24 gauge wire to 0.0425 and 0.0250 inch on 28 or 30 gauge solid copper wire it becomes increasingly difficult to obtain connections and reduced width elements, and to handle the elements. One solution was to provide a contact having reduced over-all width as is illustrated in U.S. Pat. No. 3,930,708. The elements as disclosed in this patent however did not provide as economical a connector as afforded by the present invention since more material and more handling was necessary to form the connectors.

The next improvement in the connector for closely spaced wires in a flat cable is illustrated in U.S. Pat. No. 4,009,922. This patent teaches a structure wherein the insulating body of the connector is formed with wire support surfaces which undulate to provide a lower wire support channel associated with one contact element, between two upper wire support surfaces. This structure affords contact of alternate wires with contact elements in alternate rows of contacts and provides sufficient space between the wires and contacts to avoid cross talk.

The difficulty however with this structure, when working with flat cable having wire of 30 to 34 gauge, is that the contact elements become very difficult to handle in the manufacture of the connectors. The present invention is directed at a product which provides electrical contacts in a form which may be readily handled and which afford the manufacture of substantially any shape or style of connector to meet the customer requirements. The connector may be a termination socket or header. The contact of the present invention affords the manufacture of connectors having two or more rows of contact elements and for use as a termination for flat cables of 10 to 100 wires with wires or with contacts closely spaced, e.g., on 0.0250 inch to 0.02 inch spacings. The contact of the present invention is provided with the spring compression reserve contact elements disposed in rows and joined with the wire positioning surfaces spaced to afford good electrical contact and avoid cross talk, voltage breakdown and shorting.

SUMMARY OF THE INVENTION

The present invention provides an electrical contact adapted for insertion into or over-molding into a connector housing comprising plural electrical contact elements having opposite ends and contact means at said opposite ends for connection to a conductor and other electrical component, and an integrally molded polymeric strip joining the contacts intermediate their ends. The strip has means for registration of the contacts and the strip with relationship to another strip and/or with a connector housing.

The electrical contact according to the present invention is provided with a molded strip which includes spaced conductor positioning elements positioned along said strip to position wires of a flat cable in relationship to the contact elements.

The electrical contact wire positioning elements are positioned in alternate relationship along the strip with the contact elements. Actually, there are channels formed in the strip defining lower wire supporting surfaces aligned with the wire contacting means of the contact elements and these channels are positioned between upper wire supporting surfaces positioned generally between adjacent contact elements.

An electrical contact according to the present invention provides a plurality of contact elements which are disposed in a row, each contact element having opposite ends with an insulation displacing wire receiving contact at one end and a strip of polymeric material molded onto the contact elements intermediate the ends. The strip comprises a conductor supporting element positioned one on each side of each said wire receiving contact. The conductor supporting elements have a support surface which is positioned generally on a plane with the ends of the wire receiving contacts. The supporting elements are separated by channels affording insertion of wires from a flat cable into electrical contact with the wire receiving contacts.

Identical rows of the electrical contact elements may be placed together with two rows in face to face relationship to define an insert for a premolded housing or as a mold insert such that a socket or header for a circuit board may be provided with the desired shape, length and style.

BRIEF DESCRIPTION OF THE DRAWING

The present invention will be more fully described with reference to the accompanying drawing wherein.

DETAILED DESCRIPTION OF THE PREFERRED EMBODIMENT

Figure 1:
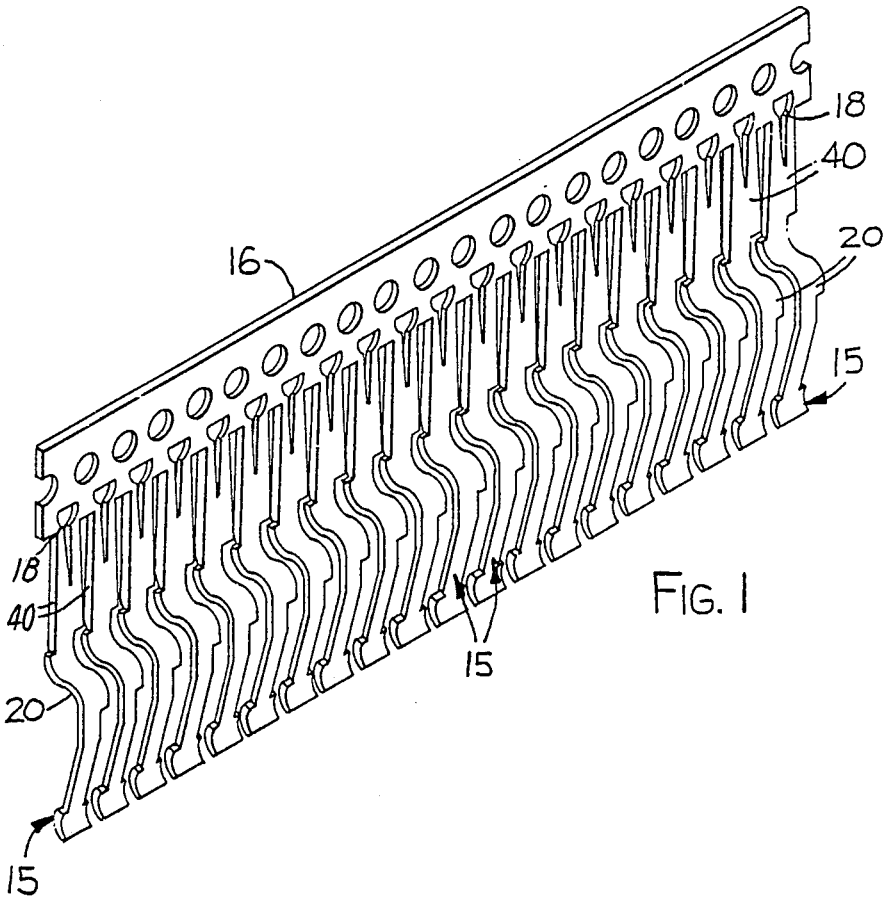
FIG. 1 is an isometric view illustrating a band of contact elements for use in manufacturing a cable terminating socket connector.

Referring now to the drawing the invention will be described with respect to its use in the manufacture of electronic products requiring the close positioning of individual electrical contact elements. The contact elements are initially formed from flat sheets of the conductive metallic material used for such elements, e.g. beryllium copper. This is usually done by stamping. The elements of FIG. 1 are formed for use in a cable termination connector and as illustrated comprise a plurality of contact elements 15 joined together at one end by a carrier strip 16 which is joined to the elements 15 at points which are easily broken away to remove the carrier strip 16. The contact elements 15 are each provided a shape or form characteristic to increase the retention of the element in the molded on strip to be applied between the contacts of the elements. As illustrated in FIG. 1 the shape or form characteristic means is an offset portion 20 of the contact elements 15 formed by two generally 90° bends in the elements.

Figure 2:
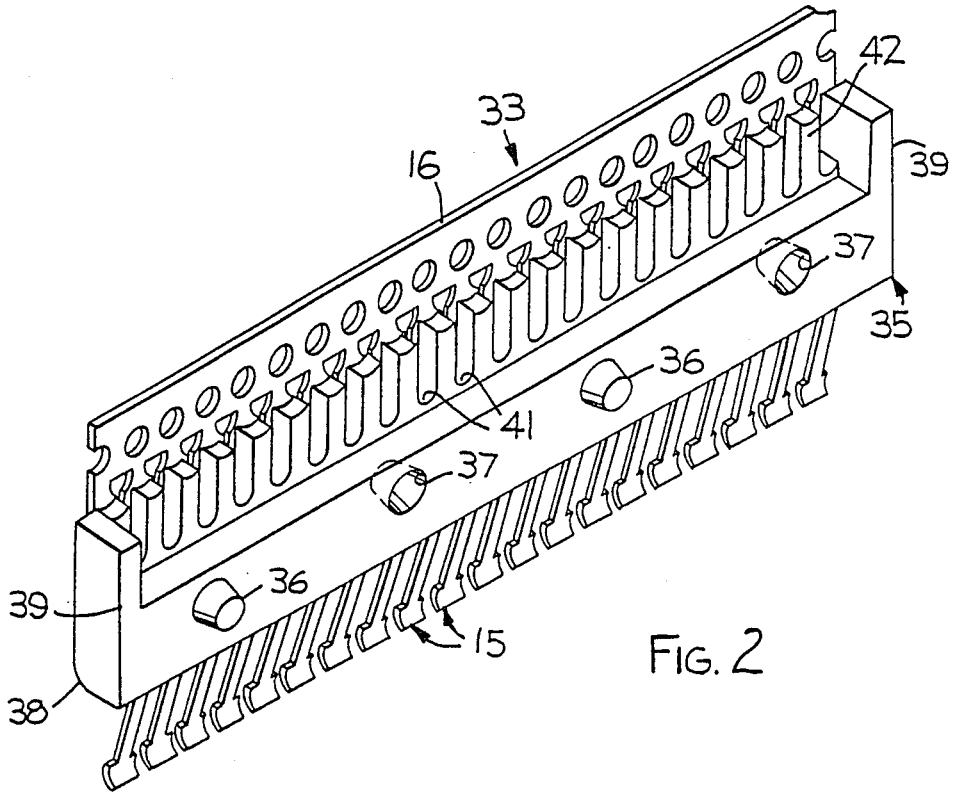
FIG. 2 is an isometric view of the band of contact elements of FIG. 1 with a strip of polymeric material molded thereto.

As illustrated in FIG. 2, the contact elements 15 have been over-molded by a polymeric insulative material to define an electrical contact 33. The molding of a strip 35 onto the contact elements 15 in the location of the offset portion 20 affords means for registration of the contact elements with other contacts and a housing. The strip 35 is provided with registration means in the form of cooperating interference fitting projections 36 and recesses 37 spaced along the length of the strip 35. The strip 35 is further provided with shoulders 38 and end members 39 which afford location means for the electrical contacts 33. The strip 35 is further provided with conductor support means for aligning closely spaced conductors with the contacts or insulation displacing contact portions 40 of the contact elements 15. These conductor support means comprise lower wire supporting channels 41 aligned with the contacts 40 to permit a conductor to be forced into engagement with the U-shaped contact 40. The channels 41 separate upper wire supporting pillars 42 having troughs formed in the upper surface to engage and support an insulation coated conductor at a height above the contacts 40. The troughs form a saddle to position the conductor along the strip 35. The edges 43 on each pillar 42 will serve to separate the conductors 64 of a flat cable 65 as will hereinafter be explained.

Figure 3:
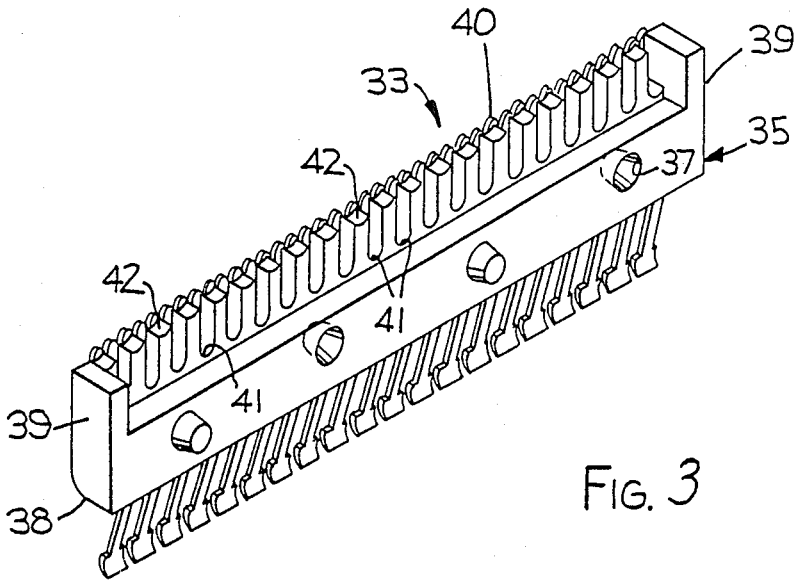
FIG. 3 is an isometric view of a band as shown in FIG. 2 with a carrier strip removed.
Figure 4:
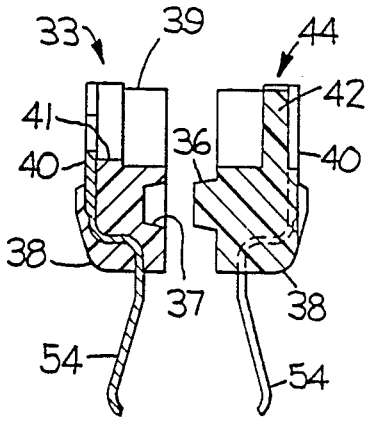
FIG. 4 is a vertical sectional view of two strips as shown in FIG. 3 placed in face to face position.
Figure 6:
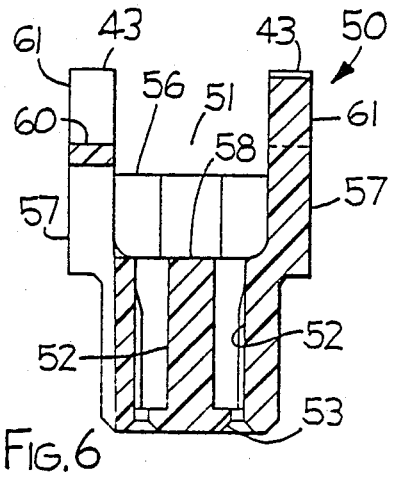
FIG. 6 is a vertical sectional view of the housing of FIG. 5.

FIG. 3 illustrates the molded electrical contact 33 with the carrier strip 16 separated from the contact elements 15 and the alignment strip 35. In this form the electrical contact is adapted to be placed in opposed relationship with an identical second electrical contact 44 of the same construction which together with the electrical contact 33 position two rows of contact elements in opposed offset relationship. Such a relationship will position the contact portions 40 in a position where the contacts on one electrical contact engage alternate wires 64 in a flat ribbon cable 65 and the contacts of the other electrical contact engage the other wires. As shown in FIG. 4, the opposed electrical contacts 33 and 44 are aligned by cooperating projections and recesses 36 and 37 respectively.

Figure 5:
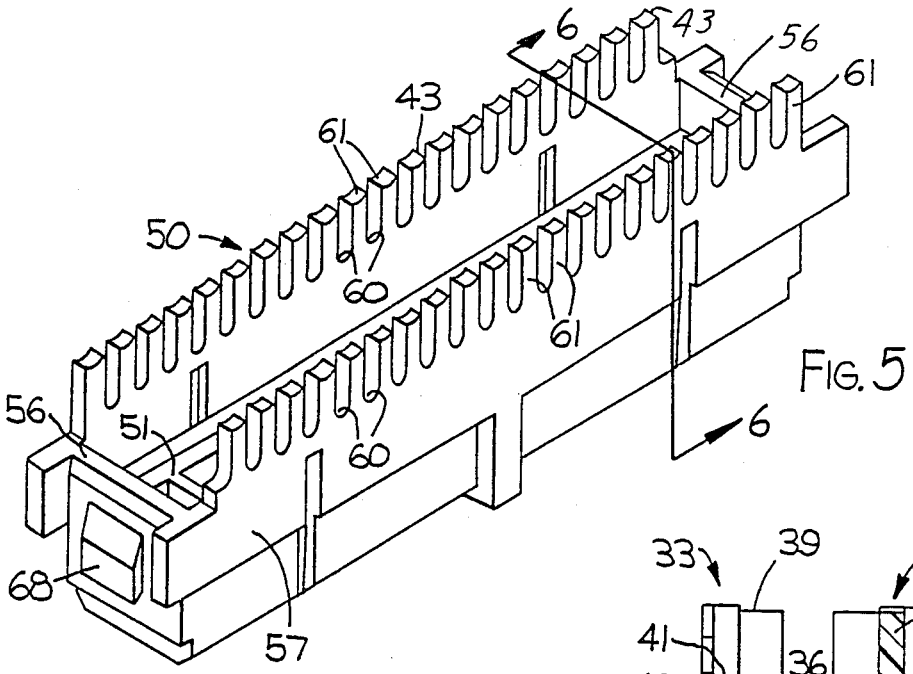
FIG. 5 is an isometric view of a housing for a connector.

When so arranged with two rows of contact elements the electrical contacts are placed in a connector housing 50 as illustrated in FIG. 5. The housing 50 is a premolded connector housing for a socket connector and has a hollow central rectangular cavity 51 shaped to receive the pair of electrical contacts 33 and 44. The housing 50 is provided with wall means forming chambers 52 having access openings 53 which chambers receive the wiping contact portions 54 of the contact elements 15. The access openings 53 are adapted to receive an external electrical contact to make a suitable connection with the contact element 15. The housing 50 is further provided with end walls 56 and side walls 57 which define the cavity 51. The bottom of the cavity 51 is perforate to provide insertion of the contact portions 54 into the chambers 52 and forms a base 58 upon which rests the shoulders 38 of the strips 35.

The side walls 57 of the housing 50 are provided at their upper surfaces with channels 60 which separate posts 61 having troughs to contact an individual conductor 64 in the cable 65. The posts 61 on one wall 57 are positioned in aligned relationship to the pillars 42 of an adjacent electrical contact. The channels 60 are positioned to be aligned with an adjacent channel 41 in a strip 35 to afford location of a conductor with a contact 40. The channels 60 on one side wall 57 are aligned transversely with a post 61 on the opposite side of the housing such that the wire adjacent to a contact 40 is spaced above the adjacent contacts 40 to restrict interference between signals carried on one wire with signals carried of the adjacent wire.

Figure 7:
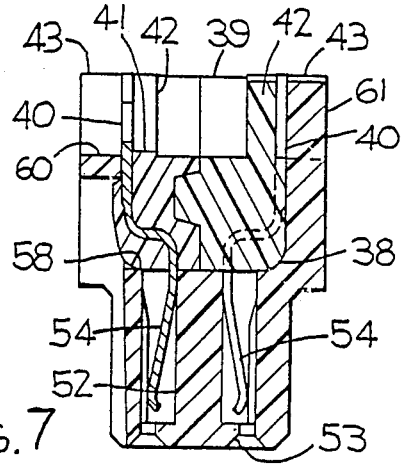
FIG. 7 is a vertical sectional view of the housing of FIG. 5 with the strips of FIG. 4 placed therein.
Figure 8:
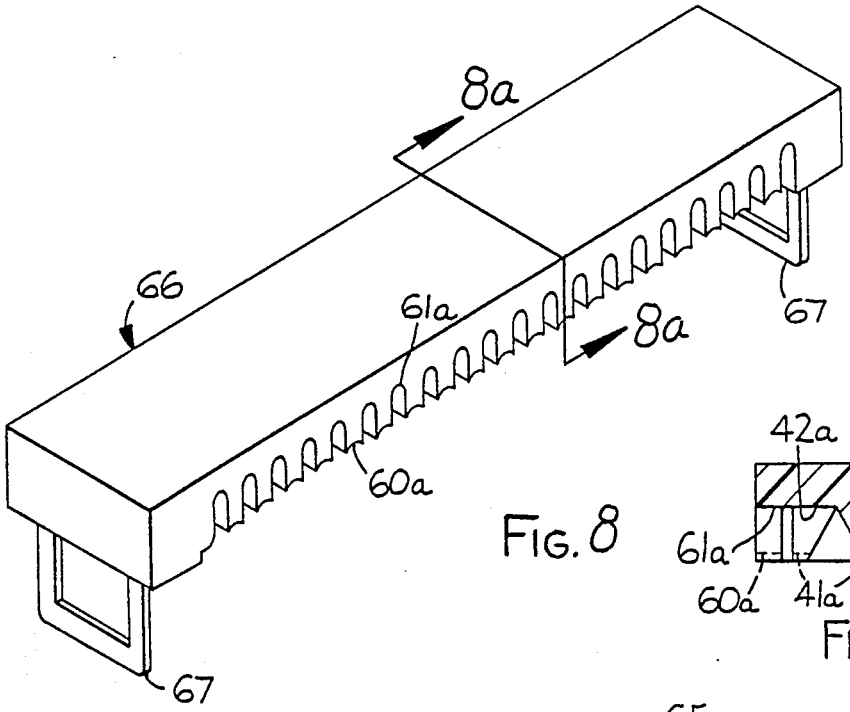
FIG. 8 is an isometric view of a cap for a connector housing constructed according to FIGS. 5 and 6.
Figure 8A:
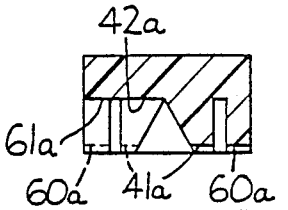
FIG. 8*a* is a transverse sectional view of the cap of FIG. 8.
Figure 9:
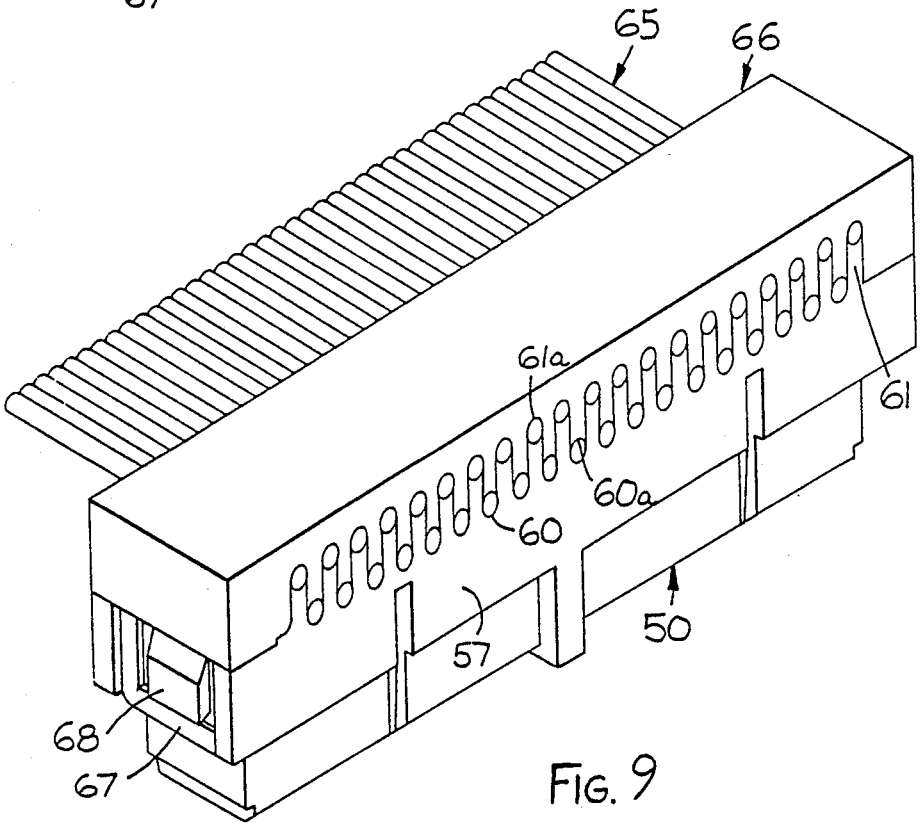
FIG. 9 is an isometric view of a termination connector and an end of the cable connected thereto with the same formed of the parts of FIGS. 3, 5, and 8.

As illustrated in FIG. 7, the assembled connector housing 50 and electrical contacts 33 and 44 are prepared to accept the ribbon cable 65. In this example the wires in the ribbon cable are positioned on 0.025 inch (0.635 mm) centers which provides a very close spacing for the contacts in the electrical contacts 33 and 44. A cap 66 or a tool face (not shown) is used to separate conductors 64 in the cable and force the conductor wires of the ribbon cable 65 into contacting engagement with the insulation displacing contact portions 40 of the contact elements 15. The cap 66 and or tool has a surface to mate with the posts 61 of housing 50 and the pillars 42 of the electrical contacts 33 and 44, affording means for separating the individual conductors in the cable and positioning the alternating wires in the channels and adjacent wires on the posts of one side and in the channels of the other side, as illustrated in FIG. 9. The cap 66, see FIG. 8*a* is provided also with spaced conductor support surfaces **60*a* separated by channels 61*a* and support surfaces 41*a* separated by channels 42*a*. The surfaces 60*a* and 41*a* are formed with arcuate troughs like the pillars 42 and posts 61. The edges of these surfaces 60*a* and 41*a* cooperate with the edges on the posts 61 and pillars 42 to shear the cable insulation between the conductors 64 to drive the conductors into the contact portions 40. The cap 66 has suitable locking means to lock the cap in place on the housing 50 after being positioned to afford the wire connections of the cable 65 to the contact elements. The locking means illustrated comprises resilient U-shaped pawls 67 at the ends of the caps. The bight portion of the pawls 67 are received over detents 68** to fit beneath the detents and hold the cap in place.

Having described the invention with reference to one embodiment of an electrical connector as illustrated in the drawings and the alternatives referred to hereinabove, it is to be understood that other changes can be made without departing from the scope of the invention as defined in the appended claims.

We claim:

1. An electrical contact adapted for insertion into a connector housing comprising plural electrical contact elements having opposite ends and contact means at said opposite ends for connection to a conductor and other electrical component, said contact means at one end including U-shaped insulation displacing contact portions disposed in a plane; and an integrally molded polymeric strip joining said contacts intermediate said ends, said strip having registration means for locating said contact elements and said strip and having spaced conductor positioning elements positioned along said strip adjacent said contact portions.

2. An electrical contact according to claim 1 wherein said positioning elements are positioned in alternate relationship along said strip with said contact portions on said one end of said contact elements.

3. An electrical contact according to claim 1 wherein said plural contact elements are positioned in rows, and said strip joins the contact elements in each row and the strip of one row is held in position in relationship to the strip of a second row by said registration means for aligning said contact elements in said one row in offset relationship to a contact element in said second row.

4. An electrical contact according to claim 1 wherein said conductor supporting elements have a support surface which is positioned generally on a plane with the ends of said wire receiving contacts and are separated by wire receiving channels aligned with said U-shaped contact portions.

5. An electrical contact according to claim 1 wherein said plural contact elements have offset means in an intermediate portion thereof for supporting said contact element in relationship to said polymeric strip when molded over said offset means.

6. An electrical contact according to claim 1 wherein said plural contact elements are positioned in a plane forming a row and said strip joins the strip of a second electrical contact element having contact portions in a second row and the strip of one row is held in position in relationship to the strip of said second contact element by said registration means for aligning said contact portions in said one row transversely with said conductor positioning elements of said second contact element forming a second row.

7. An electrical contact according to claim 6 wherein said contact elements have offset means in an intermediate portion thereof for supporting said contact element in relationship to said polymeric strip when molded over said offset means and said conductor positioning elements of said strips are positioned adjacent each other.

8. An electrical connector comprising plural electrical contact elements having opposite ends and contact means at said opposite ends for connection to a conductor and other electrical components;

a housing supporting said electrical contact elements, said housing having sidewalls, said sidewalls being formed with plural conductor supporting surfaces at one plane separated by conductor support channels at a second plane and aligned with said contact means at one end of said contact elements for connection to a conductor;

a cap having plural conductor supporting surfaces separated by conductor support channels, said conductor supporting surfaces on said cap being formed to fit snugly into said conductor support channels of said housing and said conductor supporting surfaces of said housing fitting snugly into said conductor support channels of said cap, said support surfaces being spaced to support alternate conductors of a flat multiwire cable; and said wire supporting surfaces being trough like with edges cooperating with each other to afford a shearing of the insulation between adjacent conductors in a said cable when said cap is placed on said housing with a said cable therebetween.

9. An electrical connector according to claim 8 wherein said contact means at said one end comprise an insulation displacing wire receiving contact.

10. An electrical connector according to claim 9 wherein said wire receiving contacts are positioned in a plane and are held by a polymeric strip molded over an intermediate portion of said contact elements and said strip includes conductor supporting surfaces positioned in alternate relationship along said strip with said wire receiving contacts, said conductor supporting surfaces being on a side of said wire receiving contacts opposite the conductor supporting surfaces of said housing.

* * * * *